US007286095B2

(12) United States Patent
Parsche et al.

(10) Patent No.: US 7,286,095 B2
(45) Date of Patent: Oct. 23, 2007

(54) INVERTED FEED DISCONE ANTENNA AND RELATED METHODS

(75) Inventors: Francis Eugene Parsche, Palm Bay, FL (US); Robert Patrick Maloney, Palm Bay, FL (US); Robert Nathan Lavallee, Palm Bay, FL (US)

(73) Assignee: Harris Corporation, Melbourne, FL (US)

( * ) Notice: Subject to any disclaimer, the term of this patent is extended or adjusted under 35 U.S.C. 154(b) by 0 days.

(21) Appl. No.: 11/156,684

(22) Filed: Jun. 20, 2005

(65) Prior Publication Data

US 2006/0284779 A1 Dec. 21, 2006

(51) Int. Cl.
*H01Q 13/00* (2006.01)

(52) U.S. Cl. ..... 343/773; 343/772; 343/700 MS

(58) Field of Classification Search ..... 343/790, 343/773, 759, 796, 895, 772, 700 MS
See application file for complete search history.

(56) References Cited

U.S. PATENT DOCUMENTS

| | | | | |
|---|---|---|---|---|
| 2,368,663 A | 2/1945 | Kandoian | | |
| 4,851,859 A | 7/1989 | Rappaport | ..... | 343/790 |
| 5,506,592 A * | 4/1996 | MacDonald et al. | ..... | 343/846 |
| 6,791,508 B2 * | 9/2004 | Berry et al. | ..... | 343/895 |
| 6,967,626 B2 * | 11/2005 | Apostolos | ..... | 343/774 |
| 7,002,527 B2 * | 2/2006 | Sugawara | ..... | 343/750 |
| 7,006,047 B2 * | 2/2006 | Marsan et al. | ..... | 343/705 |
| 7,023,397 B2 * | 4/2006 | Kurashima et al. | ..... | 343/845 |
| 7,027,004 B2 * | 4/2006 | Haunberger et al. | ..... | 343/790 |
| 2004/0164918 A1 * | 8/2004 | Nilsson | ..... | 343/773 |
| 2004/0233118 A1 * | 11/2004 | Jocher | ..... | 343/773 |
| 2005/0140557 A1 * | 6/2005 | Kuroda et al. | ..... | 343/773 |

* cited by examiner

*Primary Examiner*—Trinh Dinh
*Assistant Examiner*—Dieu Hien T Duong
(74) *Attorney, Agent, or Firm*—Allen, Dyer, Dopplet, Milbrath & Gilchrist, P.A.

(57) ABSTRACT

The discone antenna includes a conical antenna element, having an apex, and a disc antenna element adjacent the apex of the conical antenna element. An inverted antenna feed structure, such as a flanged coaxial connector or coaxial cable, is connected to the disc and conical antenna elements and extends outwardly from the disc antenna element on a side thereof opposite the apex of the conical antenna element. The discone antenna with such an inverted feed structure facilitates an inverted positioning, for example, on vehicles, rooftops and/or control towers, etc., that will increase the bandwidth pattern in the direction of the potential target.

12 Claims, 3 Drawing Sheets

INVERTED FEED DISCONE ANTENNA AND RELATED METHODS

FIELD OF THE INVENTION

The present invention relates to the field of antennas, and more particularly, this invention relates to low-cost broadband antennas, omnidirectional antennas, and related methods.

BACKGROUND OF THE INVENTION

Modern communications systems are ever more increasing in bandwidth, causing greater needs for broadband antennas. The simple ½ wave wire dipole antenna, which can have 2.0 to 1 VSWR bandwidth of only 4.5 percent, is often not adequate. Broadband dipoles are an alternative to the wire dipole. These preferably utilize cone radiating elements, rather than thin wires. A biconical dipole, having for example, a conical flare angle of $\frac{1}{2}\pi$ radians has essentially a high pass filter response, from a lower cut off frequency. Such an antenna provides great bandwidth, and a response of 10 or more octaves is achieved.

Wire dipoles can be easily constructed by various techniques, including modifications of coax cable. In one modification, shield braid is inverted over the coax cable outer jacket, to form the lower section of a sleeve dipole. The exposed center conductor then forms the upper half element of the dipole.

In current, everyday communications devices, many different types of conical antennas, such as biconical dipoles, conical monopoles and discone antennas are used in a variety of different ways. These antennas, however, are sometimes expensive or difficult to manufacture. A simpler method of realizing the bandwidth of conical antennas is needed, one that can utilize existing hardware, such as common flanged chassis type coaxial connectors.

Conical antennas, which include a single inverted cone over a ground plane, and biconical antennas, which include a pair of cones oriented with their apexes pointing toward each other are used as broadband antennas for various applications, for example, spectrum surveillance. A biconical antenna includes a top inverted cone, a bottom cone and a feed structure, as disclosed in U.S. Pat. No. 2,175,252 to Carter entitled "Short Wave Antenna". An electronic coupler provides a connection to a feeding circuit that provides an electrical signal that feeds the antenna. The antenna is symmetric about the cone axis and each of the cones is a full cone, spanning 360°. Referring to FIG. 2, the antenna pattern beamwidth of a conventional biconical antenna is diagrammatically illustrated. As can be seen in the diagram, the beamwidth decreases as frequency increases. This may be undesirable for various applications.

Similarly, a single cone antenna includes a single antenna cone that also spans 360° and is symmetric about the cone axis. A single antenna cone is connected to an electronic coupler that provides a connection to a feeding circuit that provides an electrical signal to feed the antenna. The single cone antenna is located over a ground plane.

An example of a discone antenna is disclosed in U.S. Pat. No. 2,368,663 to Kandoian. The discone antenna includes a conical antenna element and a disc antenna element positioned adjacent the apex of the cone. The transmission feed extends through the interior of the cone and is connected to the disc and cone adjacent the apex thereof. Also, U.S. Pat. No. 4,851,859 to Rappaport discloses a discone antenna having a conducting cone with an apex and a conducting disc with a disc feed conductor extending from its center. The conducting disc is mounted at the apex of the cone in spaced relation therewith such that the disc feed conductor extends down into the cone through the cone's apex. A coaxial connector is mounted within the cone at the apex of the cone.

Conventional discone antennas may have broad VSWR bandwidth but they suffer from narrow pattern bandwidth because the pattern droops, i.e. radiates downwards or away from the target, as the frequency increases, as illustrated in FIGS. 1A-C. Furthermore, the attachment of the antenna feed is complicated due to the routing through the cone. Accordingly, there is a need for broadband antennas that do not suffer from these drawbacks.

SUMMARY OF THE INVENTION

In view of the foregoing background, it is therefore an object of the present invention to provide a broadband antenna having an increased pattern bandwidth and with a less complicated feed attachment.

This and other objects, features, and advantages in accordance with the present invention are provided by a discone antenna including a conical antenna element, having an apex, and a disc antenna element adjacent the apex of the conical antenna element. The conical antenna element and the disc antenna element may comprise a continuous conductive layer or a wire structure, for example. An inverted antenna feed structure is connected to the disc and conical antenna elements and extends outwardly from the disc antenna element on a side thereof opposite the apex of the conical antenna element.

The antenna feed structure may be an antenna feed connector, such as a flanged coaxial cable connector with an outer conductor connected to the disc antenna element, and an inner conductor connected to the apex of the conical antenna element. Such a flanged coaxial connector may have a longitudinal axis aligned with a longitudinal axis of the conical antenna element and a center of the disc antenna element.

The antenna feed structure may be a coaxial transmission cable including an inner conductor connected to the apex of the conical antenna element, a dielectric material surrounding the inner conductor, and an outer conductor surrounding the dielectric material and connected to the disc antenna element. The coaxial transmission cable may have a longitudinal axis aligned with a longitudinal axis of the conical antenna element and a center of the disc antenna element.

A method of making a discone antenna includes providing a disc antenna element adjacent an apex of a conical antenna element, positioning an inverted antenna feed structure extending outwardly from the disc antenna element on a side thereof opposite the apex of the conical antenna element, and connecting the antenna feed structure to the disc antenna element and the conical antenna element.

The discone antenna with such an inverted feed structure according to the present invention is less expensive to make in view of the elimination of the feed connection within the cone, and because of the use of conventional flanged coaxial connectors. Furthermore, the antenna facilitates an inverted positioning, for example, on vehicles, rooftops and/or control towers, etc., that will increase the radiation pattern bandwidth in the direction of the target. The discone antenna may also be used in an upright position in a ceiling, for example, for wireless local area network (WLAN) systems.

DETAILED DESCRIPTION OF THE PREFERRED EMBODIMENTS

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout, and prime notation is used to indicate similar elements in alternative embodiments.

Figure 1C:
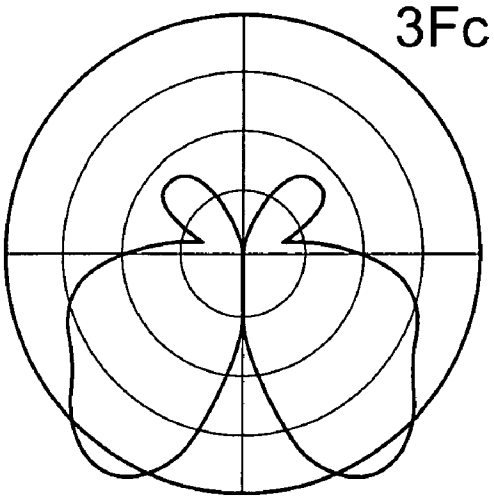
FIG. 1C (PRIOR ART)
FIGS. 1A-1C are bandwidth pattern diagrams illustrating bandwidth patterns of a conventional discone antenna at $F_c$, $2F_c$, and $3F_c$, where $F_c$ is the lower cutoff frequency.
Figure 1B:
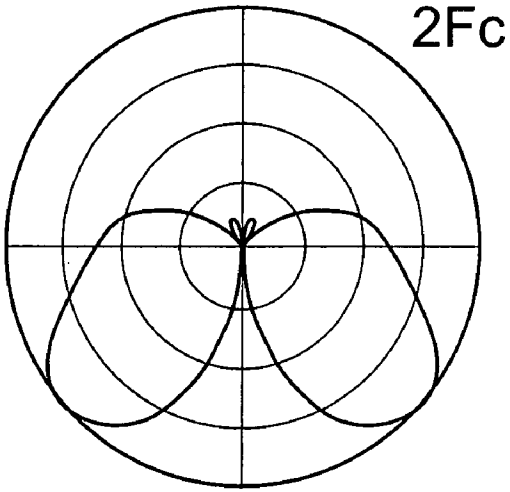
FIG. 1B (PRIOR ART)
Figure 1A:
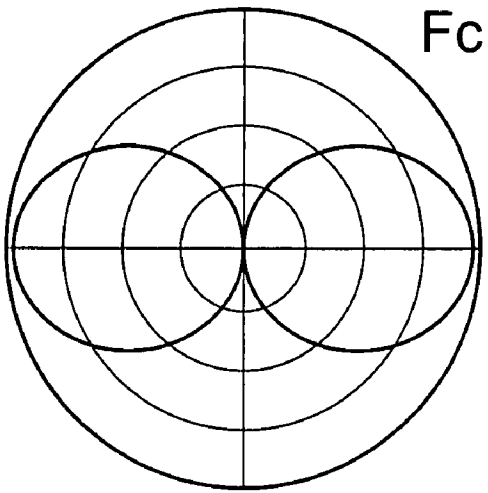
FIG. 1A (PRIOR ART)
Figure 2:
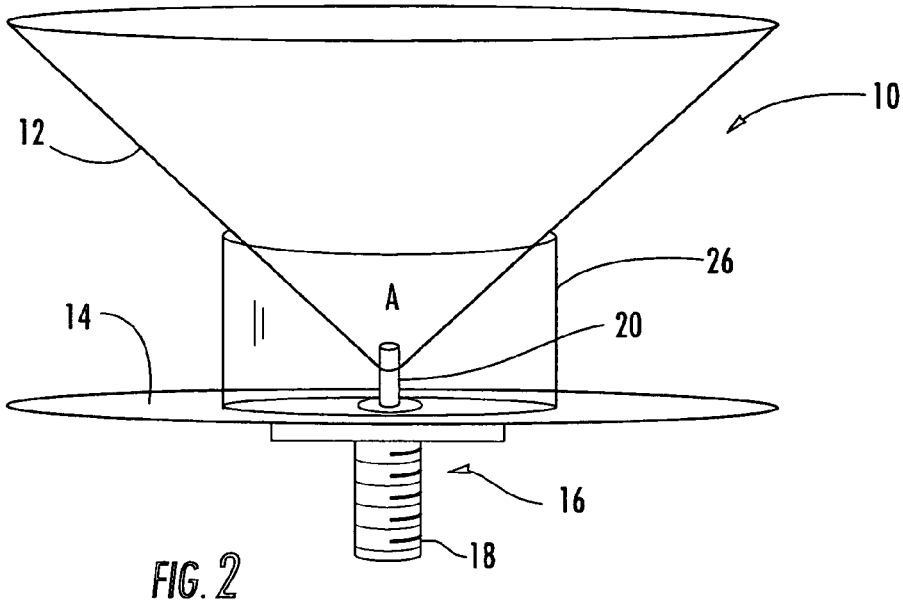
FIG. 2 is a schematic diagram illustrating an embodiment of the discone antenna having an inverted feed structure in accordance with the present invention.

Referring initially to FIG. 2, a discone antenna 10 according to the present invention will now be described. The discone antenna 10 includes a conical antenna element 12, having an apex A, and a disc antenna element 14 adjacent the apex of the conical antenna element. The conical antenna element 12 and/or the disc antenna element 14 may comprise a continuous conductive layer, such as brass sheet metal, for example. Alternatively, the conical antenna element 12 and/or the disc antenna element 14 may comprise a wire or cage structure, as would be appreciated by those skilled in the art.

An inverted antenna feed structure 16 is connected to the disc and conical antenna elements 12, 14 and extends outwardly from the disc antenna element on a side thereof opposite the apex A of the conical antenna element. As shown in the illustrated embodiment, the antenna feed structure 16 may be an antenna feed connector, such as a flanged coaxial cable connector with an outer conductor 18 connected to the disc antenna element 14, and an inner conductor 20 connected to the apex A of the conical antenna element 12. Such a flanged coaxial connector 16 preferably has a longitudinal axis aligned with a longitudinal axis of the conical antenna element 12 and a center of the disc antenna element 14.

A dielectric tube section 26, is interposed between disc 14 and conical elements 12, to strengthen the structure and resist bending moments across inner conductor 20. Dielectric tube section 26 may be held in place solely by compression, since conical element 14 acts as a centering boss. Dielectric tube section 26, is depicted as a clear material in FIG. 2, and polycarbonate tubing may be used.

Figure 4:
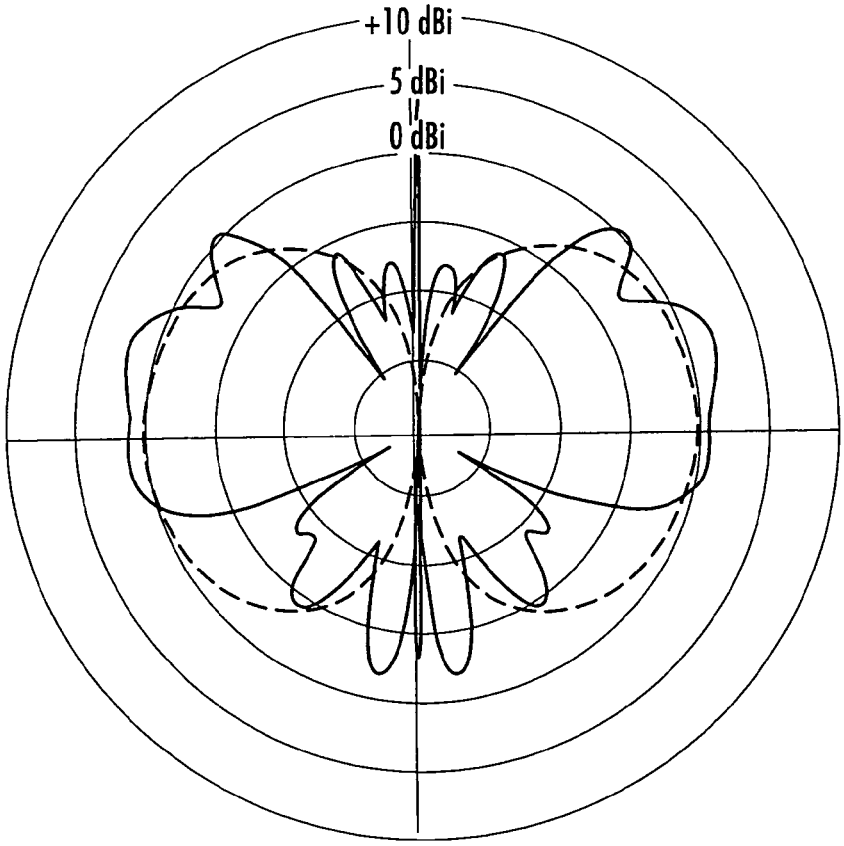
FIG. 4 is a bandwidth pattern diagram illustrating the bandwidth patterns at two different wavelengths for the discone antenna of FIG. 2.

An example of the discone antenna 10 includes the conical antenna element 12 and the disc antenna element 14 made from 0.006 inch rolled brass, with the mouth of the conical element being about 3.6 inches wide in diameter and the height thereof being about 3.5 inches. The disc antenna element may have a diameter of about 2.4 inches. The inverted antenna feed structure 16 is a flanged female coaxial connector connected to the antenna elements. Such an antenna may have radiation patterns (elevation plane pattern cuts) as shown in FIG. 4 at 1500 Mhz (dashed line) and 15,000 Mhz, (solid line). The azimuthal radiation patterns are omnidirectional and circular. The VSWR of this antenna is under 2.0 to 1 from 800 Mhz to 15,000 Mhz, when used in a 50 ohm system.

As discussed above, a conventional discone antenna typically includes a feed structure that is within the cone and a transmission cable must be attached using a crows foot wrench, as is known to those skilled in the art. In the conventional discone antenna coaxial feed structure, the outer conductor is connected to the cone, and the inner conductor is connected to the disc.

Figure 3:
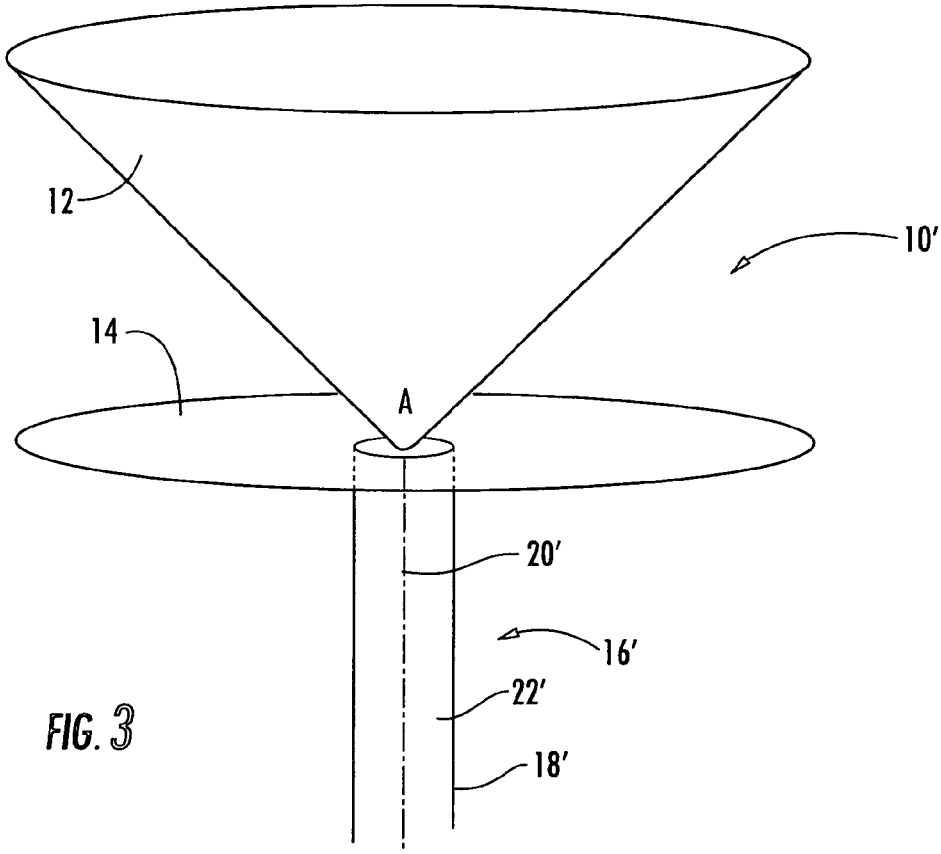
FIG. 3 is a schematic diagram illustrating another embodiment of the discone antenna having an inverted feed structure in accordance with the present invention.

Referring now to FIG. 3, another embodiment of the discone antenna 10' will be described. The antenna feed structure 16' in this embodiment is a coaxial transmission cable including an inner conductor 20' connected to the apex A of the conical antenna element 12, a dielectric material 22' surrounding the inner conductor, and an outer conductor 18' surrounding the dielectric material and connected to the disc antenna element 12. Again, the coaxial transmission cable 16' preferably has a longitudinal axis aligned with a longitudinal axis of the conical antenna element 12 and a center of the disc antenna element 14.

Figure 5:
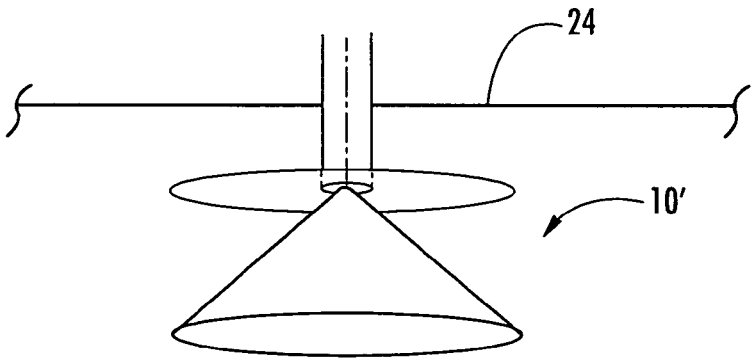
FIG. 5 is a schematic diagram illustrating the discone antenna of FIG. 3 positioned in a ceiling.

The discone antenna with such an inverted feed structure according to the present invention is less expensive to make in view of the elimination of the feed connection within the cone, and/or because of the use of conventional flanged coaxial connectors. Furthermore, the antenna facilitates an inverted positioning, for example, on vehicles, rooftops and/or control towers, etc., that will increase the radiation pattern bandwidth in the direction of a potential target, such as an aircraft. The discone antenna may also be used in an upright position in a ceiling 24 (FIG. 5), for example, for wireless local area network (WLAN) systems or ultra-wide bandwidth (UWB) antenna systems.

Disc antenna element 14 functions as an independent ground plane when discone antenna 10, 10' is mounted over a metal roof, such as on a building or motor vehicle. This is beneficial as disc element 14 is a ground plane of optimal size resulting in improved elevation plane radiation patterns. Motor vehicle roofs can be too large to be optimal ground planes at higher frequencies, resulting in a lifting of the radiation pattern off the horizon. Discone antenna 10, 10' is therefore a more foolproof antenna for consumers, as it may be mounted it over any surface, insulator or conductor.

Antenna feed structure 16 can be a SO-239 UHF connector or a type N female chassis connector. This invention is not so limited however, as to require that any specific coax connector type, or even that antenna feed structure 16 be a coax connector.

A method aspect of the invention includes a method of making the discone antenna 10, 10' including providing the disc antenna element 14 adjacent the apex A of the conical antenna element 12, positioning an inverted antenna feed structure 16, 16' extending outwardly from the disc antenna element on a side thereof opposite the apex of the conical antenna element, and connecting the antenna feed structure to the disc antenna element and the conical antenna element.

A method of manufacture is to solder antenna feed structure 16 to disc 14, and then to drill a small hole in the apex of antenna element 12 for inner conductor 20 to penetrate. Inner conductor 20 can then be soldered to conical antenna element 12.

Discone antenna 10, 10' is well suited for outdoor use. It may be desired however to prevent rain from collecting in conical antenna element 12, by configuring a radome, covering disk, or a drain hole.

Many modifications and other embodiments of the invention will come to the mind of one skilled in the art having the benefit of the teachings presented in the foregoing descriptions and the associated drawings. Therefore, it is understood that the invention is not to be limited to the specific embodiments disclosed, and that modifications and embodiments are intended to be included within the scope of the appended claims.

That which is claimed is:

1. A discone antenna comprising:

a conical antenna element having an apex and comprising a continuous conductive layer;

a disc antenna element adjacent the apex of the conical antenna element and comprising a continuous conductive layer;

an inverted antenna feed connector electrically connected to the disc and conical antenna elements and extending outwardly from the disc antenna element on a side thereof opposite the apex of the conical antenna element, the antenna feed connector comprising a flanged coaxial cable connector; and a dielectric tube section surrounding the apex of the conical antenna element spaced apart therefrom and extending between the disc antenna element and the conical antenna element.

2. The discone antenna according to claim 1 wherein the flanged coaxial cable connector comprises:

an outer conductor electrically connected to the disc antenna element; and an inner conductor electrically connected to the apex of, and extending into, the conical antenna element.

3. The discone antenna according to claim 1 wherein the flanged coaxial cable connector has a longitudinal axis aligned with a longitudinal axis of the conical antenna element and a center of the disc antenna element.

4. The discone antenna according to claim 1 wherein the dielectric tube section is positioned between medial portions of the conical antenna element and the disc antenna element.

5. An inverted discone antenna comprising:

a conical antenna element having an apex and comprising a continuous conductive layer;

a disc antenna element adjacent the apex of the conical antenna element and comprising a continuous conductive layer;

a coaxial antenna feed structure comprising an outer conductor electrically connected to the disc antenna element, and an inner conductor electrically connected to the conical antenna element; and a dielectric tube section surrounding the apex of the conical antenna element spaced apart therefrom and extending between the disc antenna element and the conical antenna element.

6. The discone antenna according to claim 5 wherein the coaxial antenna feed structure comprises an antenna teed connector.

7. The discone antenna according to claim 6 wherein the antenna feed connector comprises a flanged coaxial cable connector.

8. The discone antenna according to claim 5 wherein the antenna feed structure comprises a coaxial transmission cable.

9. The inverted discone antenna according to claim 5 wherein the dielectric tube section is positioned between medial portions of the conical antenna element and the disc antenna element.

10. A method of making a discone antenna comprising:

providing a disc antenna element adjacent an apex of a conical antenna element, the disc antenna element and the conical antenna element each comprising a continuous conductive layer;

positioning an inverted antenna feed connector extending outwardly from the disc antenna element on a side thereof opposite the apex of the conical antenna element, and electrically connecting the inverted antenna feed connector to the disc antenna element and the conical antenna element, the inverted antenna feed connector comprising a flanged coaxial cable connector; and positioning a dielectric tube section surrounding the apex of the conical antenna element spaced apart therefrom and extending between the disc antenna element and the conical antenna element.

11. The method according to claim 10 wherein positioning the flanged coaxial cable connector comprises:

electrically connecting an outer conductor to the disc antenna element; and electrically connecting an inner conductor to the apex of, and extending the inner conductor into, the conical antenna element.

12. The method according to claim 10 wherein the dielectric tube section is positioned between medial portions of the conical antenna element and the disc antenna element.

* * * * *

UNITED STATES PATENT AND TRADEMARK OFFICE

CERTIFICATE OF CORRECTION

PATENT NO. : 7,286,095 B2
APPLICATION NO. : 11/156684
DATED : October 23, 2007
INVENTOR(S) : Parsche et al.

It is certified that error appears in the above-identified patent and that said Letters Patent is hereby corrected as shown below:

| | |
|---|---|
| Column 4, Line 49 | Delete: "mounted it over"<br>Insert: -- mounted over -- |
| Column 6, Line 9 | Delete: "teed"<br>Insert: -- feed -- |

Signed and Sealed this

Fifteenth Day of July, 2008

JON W. DUDAS
*Director of the United States Patent and Trademark Office*